United States Patent [19]

Hasker et al.

[11] 4,277,713

[45] Jul. 7, 1981

[54] LOW-PRESSURE GAS DISCHARGE LAMP AND METHOD FOR MAKING

[75] Inventors: Jan Hasker; Johannes C. G. Vervest; Cornelis Peters; Laurentius C. J. Vroomen, all of Eindhoven, Netherlands

[73] Assignee: U.S. Philips Corporation, New York, N.Y.

[21] Appl. No.: 52,374

[22] Filed: Jun. 27, 1979

[30] Foreign Application Priority Data

Jul. 4, 1978 [NL] Netherlands ..... 7807218

[51] Int. Cl.[3] ..... H01J 9/00; H01J 61/04

[52] U.S. Cl. ..... 313/203; 29/25.13; 65/12

[58] Field of Search ..... 313/203, 222, 292, 485; 29/25.13; 65/2, 12

[56] References Cited

U.S. PATENT DOCUMENTS

| | | | |
|---|---|---|---|
| 1,879,470 | 9/1932 | Pirani | 313/204 X |
| 4,143,447 | 3/1979 | Hasker et al. | 313/203 X |

*Primary Examiner*—Palmer C. Demeo
*Assistant Examiner*—Darwin R. Hostetter
*Attorney, Agent, or Firm*—Robert S. Smith

[57] ABSTRACT

Low-pressure discharge lamp having an elongate discharge vessel which contains a thinly distributed filamentary body permeable to the gas discharge, said body comprising a helical support filament which is supported by the inner surface of the discharge vessel and is at least one further filament, supported by the support filament and extending therefrom towards the axis fo the discharge vessel.

2 Claims, 3 Drawing Figures

LOW-PRESSURE GAS DISCHARGE LAMP AND METHOD FOR MAKING

Figure 1:
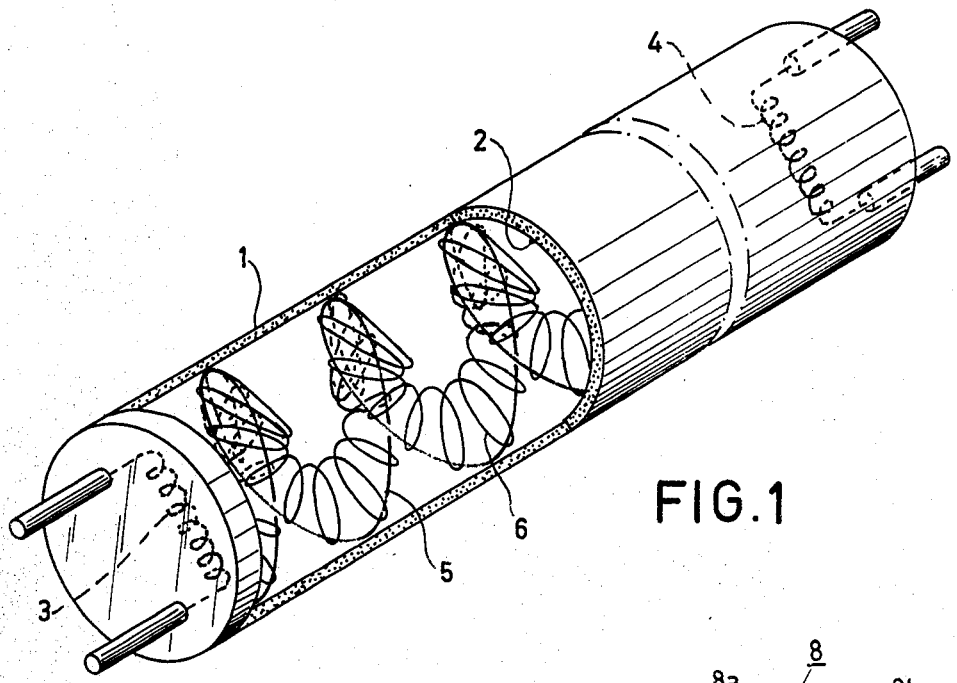

The invention relates to a low-pressure discharge lamp having an elongate discharge vessel which contains a thinly distributed filamentary bond permeable to the discharge.

From United Kingdom Patent Specification No. 1,464,063 it is known to provide in the discharge vessel of a low-pressure discharge lamp, such as a low-pressure mercury vapor discharge lamp or a low-pressure sodium vapor discharge lamp a thinly distributed filamentary body having a construction permeable to the discharge, such as thinly distributed glass, quartz or gehlenite glass wool to increase the light output per unit volume of the lamp. The effect of the presence of such a body is that, for the same power applied to the lamp, the lamp voltage is considerably increased. This increases the efficiency of the lamp together with the necessary ballast compared to lamps not provided with such a body.

One of the requirements which lamps, particularly low-pressure mercury vapor discharge lamps provided with such a body must satisfy within reasonable limits is that the distribution along the discharge vessel of the portions from which the body is constructed (such as, for example, a filamentary wool structure) is reasonably uniform because otherwise, owing to inhomogeneities in the discharge, unwanted differences in the light intensity and the temperature are produced over the tube wall. In low-pressure mercury vapor discharge lamps these temperature differences give rise to mercury deposits on the colder portions and in low-pressure sodium lamps to the formation of sodium mirrors in the colder spots.

It is an object of the invention to provide a lamp which satisfies the above-mentioned requirement. In addition, it is an object of the invention to provide such a lamp in which the body can be produced outside the discharge vessel and whereby, both during the insertion of the body into the discharge vessel and during operation of the lamp the shape of the body and the cohesion between the parts from which the body is constructed are substantially undisturbed.

According to the invention there is provided a low-pressure discharge lamp of the type defined in the opening paragraph, which is characterized in that said body comprises a helical support filament extending substantially over the entire length of the discharge vessel adjacent the inner surface thereof and at least one further filament supported by the support filament and extending therefrom towards the axis of the discharge vessel.

A thin body having such a structural shape has the advantage that during production of the lamp the structure is hardly subjected to any shape changes and that it can be positioned properly in the discharge vessel. As a result the necessary uniform distribution of the parts from which the body consists is preserved. Such a structure has special advantages for the manufacture of lamps provided with a curved (e.g. circular) discharge vessel. Namely, if the body is first disposed in a straight elongate discharge vessel, a uniformly distributed thin body is obtained in a simple manner after curving the discharge vessel. Also during the so-called "pumping" of the lamp, after the body has been disposed in the discharge vessel, said body retains its original form.

"Pumping" is here understood to mean filling the lamp with a desired gas atmosphere (mercury excepted), glowing and outgassing of electrodes, outgassing of the wall and other lamp components in the discharge vessel etc.

The helical support filament according to the invention can have different shapes. It can, for example, consist of a wire which bears on the wall of a circle-cylindrical discharge vessel and which varies according to a pattern of staggered ellipses or triangles, the wire extending along the entire length of the discharge vessel.

The further filament supported by the support filament can, for example, consist of fibres which are substantially perpendicular to the wall of the discharge vessel and which are attached to the turns of the support filament.

Preferably, said further filament is helically coiled around the support filament. The complete body then has the form of a coiled coil. Such a construction has the advantage (particularly for lamps having a circle-cylindrical discharge vessel whose inside diameter corresponds approximately to the diameter of the turns of the helical support filament) that no mechanical interconnection of the two coils is needed. Such a construction can be disposed in a simple manner in the discharge vessel, for example by slightly stretching the supporting coil to reduce its diameter whereafter the structure is supported by and held in the discharge vessel by allowing the supporting coil to spring back to its original shape.

The invention may be used in widely divergent types of low-pressure discharge lamps; typical examples are low-pressure sodium vapor discharge lamps and low-pressure mercury vapor discharge lamps provided or not provided with a luminescent coating.

It is of course desirable that the material of the body according to the invention has no adverse effects during manufacture and during the life of the lamp. Consequently, materials are preferably chosen which emit as little gas as possible, which do not decompose and which cannot be attacked by the gas discharge and absorb the produced useful radiation to a very low extent only. Glass is an example of a suitable material. Since the sodium vapor in a low-pressure sodium vapor discharge lamp is very aggressive, the thinly distributed filamentary body in such lamps should preferably be sodium-resistant; a body consisting of or coated with gehlenite glass is particularly suitable for this purpose. Gehlenite glass is also a suitable material if the discharge vessel must be subjected to an additional curving operation after disposal of the thin body. As the softening temperature of the gehlenite glass is in general higher than that of the glass wall of the discharge vessel the cohesion and the regular built-up of the thin body are hardly disturbed by the thermal treatment necessary for the curving operation.

Figure 2:
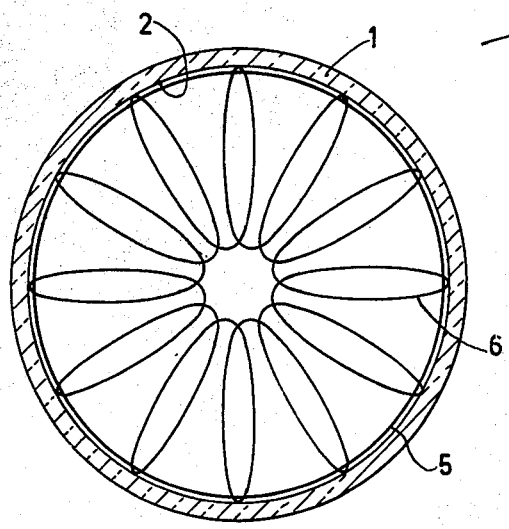
Figure 3:
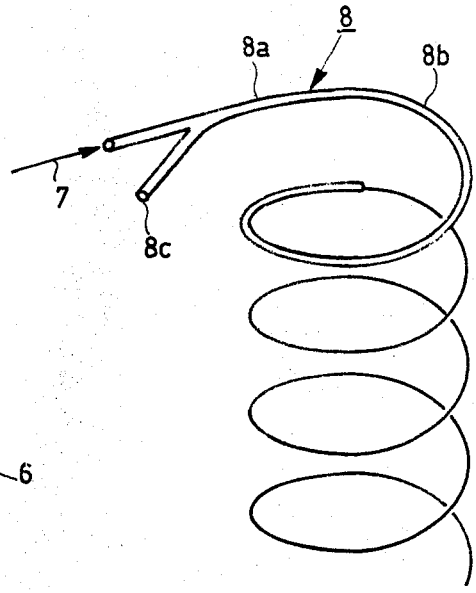

An embodiment of the invention will now be described with reference to the accompanying drawing, of which FIG. 1 shows a low-pressure mercury vapor discharge lamp according to the invention, FIG. 2 shows in representational form a cross-section through the lamp shown in FIG. 1, and FIG. 3 shows schematically a forming tube for a method of producing a spiral glass wire for use in a lamp according to the invention.

The lamp shown in FIG. 1 has a glass cylindrical discharge vessel 1 provided on its inner surface with a luminescent coating 2, consisting of manganese and antimony-activated calcium halophosphate. The discharge vessel contains a small quantity of mercury as well as a mixture consisting of 75% (by vol) argon and 25% (by vol) neon at a pressure of 2.5 Torr. In the discharge vessel, between the electrodes 3 and 4 (which are approximately 55 cm apart) there is a thinly distributed filamentary body having a structure permeable to the discharge. This body comprises a helical support filament 5 extending substantially over the entire length of the discharge vessel adjacent the inner surface thereof. This supporting wire 5 consists of glass having a thickness of 200 μm. The diameter of the helix of this support filament approximately corresponds to the inside diameter of the discharge vessel and is approximately 25 mm. The pitch of the helix is approximately 1.7 cm. A further filament 6 extending towards the axis of the discharge vessel is coiled around this glass supporting wire 5 along the turns thereof, with a winding sense which is substantially parallel to the turns of the supporting wire 5. The wire 6 is approximately 20 μm. thick. This wire 6 (average pitch 4 mm, diameter 12 mm) extends over substantially the entire volume of the discharge vessel (see FIG. 2). The complete body has the form of a coiled coil.

In a practical embodiment of an above-described low-pressure mercury vapor discharge lamp according to the invention the luminous flux was approximately 3000 lumen at a lamp load of 40 W and the operating voltage was approximately 100 V.

The entire thinly distributed body can be produced by first producing the supporting coil 5 and by thereafter pushing coil 6 along the turns of coil 5. The glass coils 5 and 6 are manufactured by passing a glass wire 7 (see FIG. 3) through a tube 8 (consisting, for example, of chromium-nickel-steel) which has an elongate portion 8*a* followed by a helical portion 8*b*, this helical portion having a diameter and pitch corresponding to the pitch and diameter of the required filament 5 and 6 respectively (for the above mentioned dimensions of supporting wire 5 the inside diameter of the tube is approximately 1 mm, for wire 6 approximately 0.5 mm). The glass wire 7 is applied to the elongate portion 8*a* of the tube. The tube is heated in the elongate portion 8*a* and a neighbouring part of the curved portion 8*b* to a temperature which is sufficient to heat the glass wire 5 or 6 its softening temperature, so that the emerging glass wire is permanently deformed into a coil. It is also possible to produce by means of this method non-circle-cylindrical coils of glass wire by varying the temperature periodically during heating. To prevent the glass from sticking to the inner wall of the tube during the forming process, the inner surface of tube 8 is provided with a coating. An inert gas is passed through the tube (via opening 8*c*) to prevent the coating from being attacked by the air.

What is claimed is:

1. A low-pressure discharge lamp having an elongate discharge vessel which contains a thinly distributed filamentary body, permeable to the discharge, characterized in that said body comprises a helical support filament extending substantially over the entire length of the discharge vessel at least partly adjacent the inner surface thereof and at least one further filament supported by the support filament and extending therefrom towards the axis of the discharge vessel, said one further filament being helically coiled around said support filament.

2. A method of producing a helical filament for use in a low-pressure gas discharge lamp which comprises passing a glass wire through a tube having an elongated axial section followed by a second axial section having a helical portion, said helical portion having a pitch and a diameter corresponding to the pitch and diameter of the required filament coil, said method including heating at least the elongate portion of the tube to a temperature sufficient to soften the glass wire.

* * * * *